US008118358B2

(12) United States Patent
Wright et al.

(10) Patent No.: US 8,118,358 B2
(45) Date of Patent: Feb. 21, 2012

(54) CHAIR

(75) Inventors: Douglas G. Wright, Morristown, TN (US); Mark T. Proffitt, Greeneville, TN (US); George Lawrence Huff, Afton, TN (US); Stephen J. Zwonitzer, Atlanta, GA (US); Robert B. Holben, Roswell, GA (US); Kurt Rampton, Atlanta, GA (US)

(73) Assignee: Meco Corporation, Greenville, TN (US)

( * ) Notice: Subject to any disclaimer, the term of this patent is extended or adjusted under 35 U.S.C. 154(b) by 676 days.

(21) Appl. No.: 12/033,750

(22) Filed: Feb. 19, 2008
(Under 37 CFR 1.47)

(65) Prior Publication Data

US 2008/0238157 A1 Oct. 2, 2008

Related U.S. Application Data

(60) Provisional application No. 60/890,716, filed on Feb. 20, 2007.

(51) Int. Cl.
*A47C 4/08* (2006.01)

(52) U.S. Cl. ..... 297/60

(58) Field of Classification Search ..... 297/16.1, 297/59, 60

See application file for complete search history.

(56) References Cited

U.S. PATENT DOCUMENTS

| | | | | | |
|---|---|---|---|---|---|
| 407,714 | A | * | 7/1889 | Albert | 297/60 |
| 428,032 | A | * | 5/1890 | Albert | 297/60 |
| 1,161,609 | A | * | 11/1915 | Burkhartzmeyer | 297/60 |
| 1,471,007 | A | * | 10/1923 | Schmidt | 297/154 |
| 2,235,775 | A | * | 3/1941 | Rastetter, Jr. | 297/41 |
| 2,633,183 | A | * | 3/1953 | Norquist | 297/41 |
| D177,922 | S | * | 6/1956 | Orsborn | D6/343 |
| 3,074,757 | A | * | 1/1963 | Weagle | 297/30 |
| 3,120,976 | A | * | 2/1964 | Van Syoc | 297/60 |
| 3,189,380 | A | * | 6/1965 | Reguitti | 297/188.03 |
| 4,662,675 | A | | 5/1987 | Volpi | |
| 6,511,122 | B1 | | 1/2003 | Chen | |
| 6,969,113 | B2 | | 11/2005 | Krawchuk | |

FOREIGN PATENT DOCUMENTS

| | | | |
|---|---|---|---|
| JP | 2003-088442 | A | 3/2003 |
| KR | 10-2006-0057300 | A | 5/2006 |

OTHER PUBLICATIONS

International Search Report and Written Opinion, dated Jun. 24, 2008.

* cited by examiner

*Primary Examiner* — Peter R. Brown
(74) *Attorney, Agent, or Firm* — McGuireWoods LLP

(57) ABSTRACT

A folding chair includes a back frame including at least one rear leg, a seat frame pivotally connected to the back frame, at least one front leg pivotally connected to the seat frame, a link connected to the at least one front leg and the at least one rear leg to pull the front leg toward the back frame when the folding chair is folded, and a seat panel pivotally connected to the seat frame and configured to be separated from the seat frame when the folding chair is folded.

18 Claims, 6 Drawing Sheets

CHAIR

CROSS REFERENCE TO PRIOR APPLICATION

This application claims priority and the benefit thereof from U.S. Provisional Application Ser. No. 60/890,716 filed Feb. 20, 2007, which is hereby incorporated by reference for all purposes as if fully set forth therein.

BACKGROUND OF THE INVENTION

1. Field of the Invention

The invention is directed to a folding chair, and more particularly to a folding chair with an improved folding mechanism.

2. Related Art

As well known in the art, a folding chair is a light portable chair that can be folded and stored in a stack or row. Folding chairs are frequently used for temporary seating situations such as parties, ceremonies, concerts and the like. Folding chairs are mostly made of hard plastic, metal or wood with pivots to allow folding.

Depending on the pivot locations, folding chairs may be divided into two major categories: pivot under seat level and pivot at (or above) seat level. The pivot under seat level category may be further divided into minor categories such as a side X stool, a side X chair, a front X chair and the like. As shown in FIG. 1(*a*), a side X stool has two X shaped legs aligned with a piece of cloth between. FIG. 1(*b*) shows a side X chair, of which the supports for the backrest and the front feet are invariably the same part. The seat for the side X chair is collapsed with the sidebars, either downwards between the front legs, or upwards to align between back sidebars. As shown in FIG. 1(*c*), the front X chair is essentially a side-x stool with a backrest. The "pivot at (or above) seat level" category typically includes a triangle shape folding chair, which is the most common type of folding chairs. As shown in FIG. 1(*d*), the seat of the triangle shape folding chair automatically aligns between the back supports, and the support for the backrest and the front legs are the same part.

The aforementioned conventional folding chairs, however, suffer from one or more drawbacks such as being bulky, trouble-prone, unreliable in use, and visually unattractive. Accordingly, there is a need for an improved folding chair design that is less bulky, less trouble-prone, more reliable, and more visually attractive.

SUMMARY OF THE INVENTION

The invention meets the foregoing needs, which results in a significant improvement over the conventional folding chairs and other advantages apparent from the discussion herein. Thus, the invention provides a novel folding chair in order to overcome the above drawbacks of the prior art.

According to an aspect of the invention, a folding chair includes a back frame including at least one rear leg, a seat frame pivotally connected to the back frame, at least one front leg pivotally connected to the seat frame, a link connected to the at least one front leg and the at least one rear leg to pull the front leg toward the back frame when the folding chair is folded, and a seat panel pivotally connected to the seat frame and configured to be separated from the seat frame when the folding chair is folded.

The folding chair may further include a back panel attached to the back frame. The back frame may includes a pair of vertical bars, each including an upper portion and a lower portion, and a horizontal bar interconnecting the pair of vertical bars, wherein the lower portions of the pair of vertical bars include two of the at least one rear leg to form a pair of rear legs. The back panel may be attached to the upper portions of the pair of vertical bars. The at least one front legs may include a pair of front legs.

The seat frame may include a pair of side frames pivotally connected to the rear frame, the seat panel and the pair of front legs, and a bridge frame connected to the pair of side frames and configured to support the seat panel when the folding chair is unfolded. The side frames may include L-shaped rear end portions pivotally connected to ends of the vertical bars, respectively. Each vertical bar may include a cutout portion configured to engage the L-shaped rear end portion of the side frame of the seat frame.

The seat frame may further include at least one hook configured to engage the horizontal bar of the rear frame when the folding chair is unfolded. The at least one hook may include a pair of hooks attached on a bottom surface of the seat frame and pivotally connected to inner side surfaces of the side frames of the seat frame. The folding chair may further include rivets pivotally connecting the pair of side frames to the rear frame, the seat panel and the pair of front legs. The at least one front leg may include a pair of front legs.

The link may include a front bar connected to the pair of front legs, a rear bar connected to the pair of rear legs, and a bridge coupled between the front bar and the rear bar. The folding chair may further include rivets pivotally connecting the front and rear bars of the link to the front and rear legs.

According to another aspect of the invention, a folding chair includes a rear frame including a pair of rear legs, a rear panel attached to the rear frame, a seat frame pivotally attached to the rear frame and configured to move towards the rear panel when the folding chair is folded, a seat panel mounted on and pivotally attached to the seat frame and configured to be separated from the seat frame and move towards the rear panel when the folding chair is folded, a pair of front legs pivotally attached to the seat frame, and a link pivotally connected to the pair of front legs and the pair of rear legs and configured to pull the pair of front legs towards to rear frame when the folding chair is folded.

The folding chair may further include rivets pivotally connecting the seat frame to the rear frame, the seat panel and the pair of front legs, and pivotally connecting the link to the pair of front legs and the pair of rear legs. The folding chair may further include at least one hook attached to the seat panel and configured to engage the rear frame when the folding chair is unfolded. The at least one hook may include a pair of hooks attached at a bottom surface of the seat panel and configured to pivotally connect the seat panel to the seat frame.

The rear frame may include a pair of vertical bars, each divided into an upper portion and a lower portion, wherein the lower portions of the pair of vertical bars constitute the pair of rear legs, a horizontal bar extending between the pair of vertical bars, wherein the at least one hook engages the horizontal bar when the folding chair is unfolded.

The link include a front bar pivotally connected to the pair of front legs, a rear bar pivotally connected to the pair of rear legs, and a bridge extending between the front bar and the rear bar.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1A:
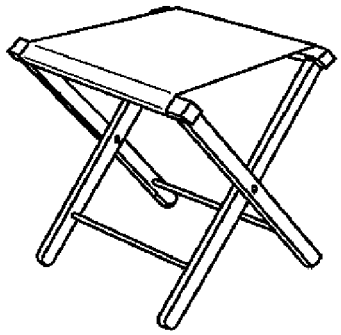
FIG. 1(a) Prior Art
FIGS. 1(*a*), 1(*b*), 1(*c*) and 1(*d*) show conventional folding chairs.
Figure 1B:
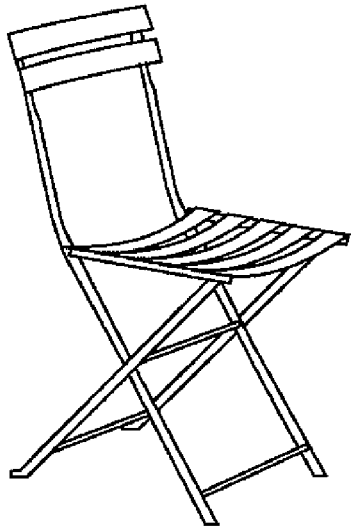
FIG. 1(b) Prior Art
Figure 1C:
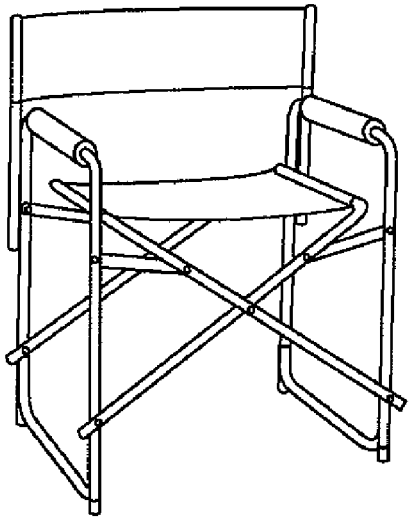
FIG. 1(c) Prior Art
Figure 1D:
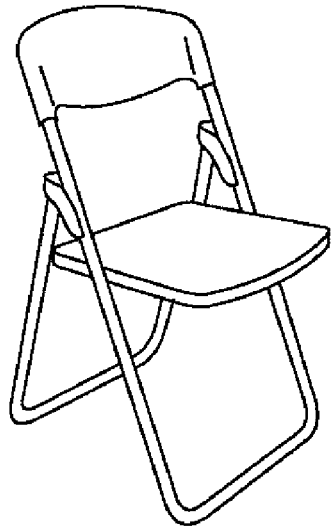
FIG. 1(d) Prior Art

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

Figure 2:
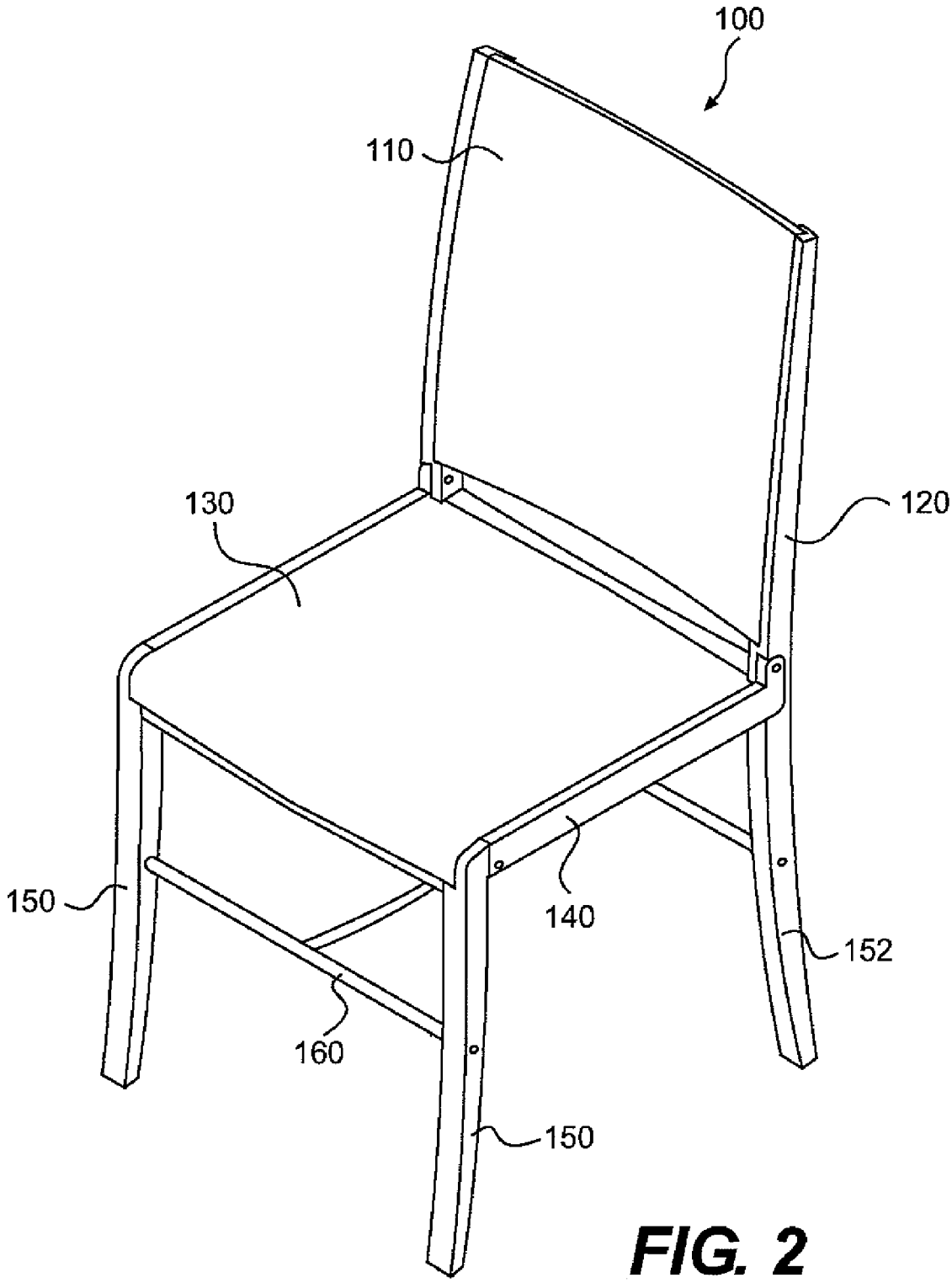
FIG. 2 is a perspective view of a folding chair constructed according to the principles of the invention.

FIG. 2 shows a perspective view of a folding chair 100 in the unfolded position constructed according to the principles of the invention. As shown therein, the folding chair 100 may include a back panel 110, a back frame 120 including a pair of rear legs 152, a seat panel 130, a seat frame 140, a pair of front legs 150, and a link 160. However, as the skilled artisan will readily recognize, the folding chair 100 may be configured in different configurations with different components, without departing from the scope and/or spirit of the invention. For example, the back panel 110 may be attached to the back frame 120, or, alternatively, the back panel 110 may be integral to the back frame 120. As further shown in FIG. 2, the folding chair 100 in the unfolded position may not have the unique appearance of the conventional folding chairs shown in FIGS. 1(*a*), 1(*b*), 1(*c*) and 1(*d*), and thus may appear more aesthetically pleasing to users compared to the conventional folding chairs.

Figure 3:
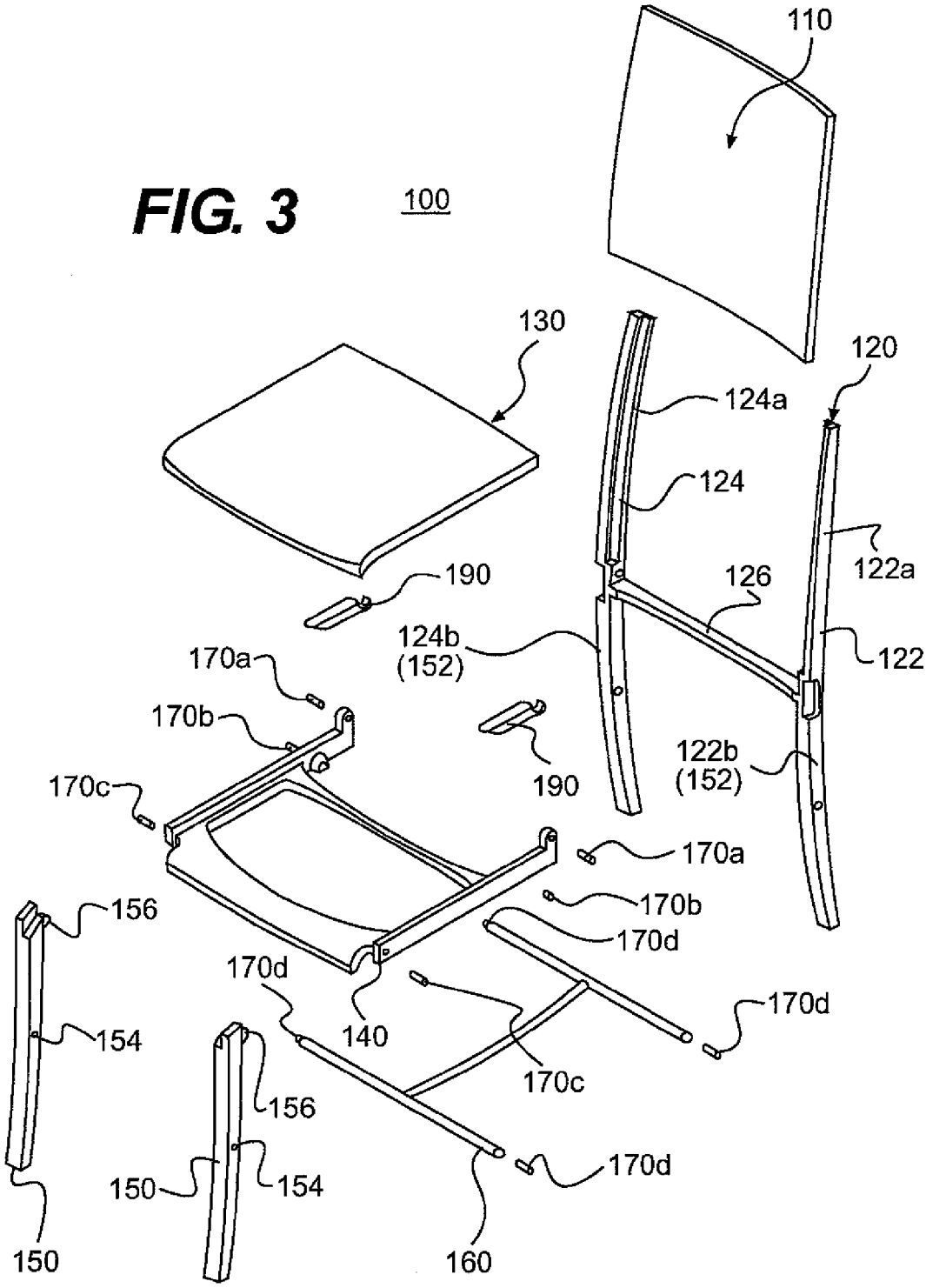
FIG. 3 is an exploded perspective view of the folding chair shown in FIG. 2 constructed according to the principles of the invention.

FIG. 3 shows an exploded perspective view of the folding chair 100 of FIG. 2. To establish folding mechanism, the back frame 120, the seat panel 130, the seat frame 140, the front legs 150 and the link 160 may be pivotally connected to each other. For example, the seat frame 140 may be pivotally connected to the back frame 120 with rivets 170*a*, the seat panel 130 may be pivotally connected to the seat frame 140 with rivets 170*b*, the front legs may be pivotally connected to the seat frame 140 with rivets 170*c*, and the link 160 may be pivotally connected to the front and rear legs 150, 152 with rivets 170*d*. However, as the skilled artisan will readily recognize and appreciate, without departing from the scope and/spirit of the invention, any mechanical fasteners that allow pivotal movement may be used in replacement of the rivets 170*a*, 170*b*, 170*c* and 170*d*.

In an embodiment of the invention, the back frame 120 may be configured to be "H" shaped, as shown in FIG. 3. The back frame 120 may be constructed with two vertical bars 122, 124 and a horizontal bar 126 interconnecting the vertical bars 122, 124. The vertical bars 122, 124 may be divided into upper portions 122*a*, 124*b* and lower portions 124*a*, 124*b*, respectively. The upper portions 112*a*, 124*a* may be used to support the back frame 110, and the lower portions 122*b*, 124*b* may constitute the rear legs 152. The back panel 110 may be attached to the upper portions 122*a* and 124*a* of the back panel.

As mentioned above, the seat frame 140 may be pivotally attached to the back frame 120 with the rivets 170*a* such that the seat frame 140 may pivotally move towards the back panel 110 when the folding chair 100 is folded. The seat panel 130 may be pivotally attached to and mounted on the seat frame 140 with the rivets 170*b* such that the seat panel 130 may be separated from the seat frame 140 and pivotally move towards the back frame 120. The link 160 may be pivotally connected to the front legs 150 and the rear legs 152 with the rivets 170*d* such that the front legs 150 are pulled towards the bottom of the seat frame 140 when the folding chair 100 is folded. Each of the front legs 150 may include holes 154, 156 to engage the rivets 170*d*, 170*c*, respectively.

In an embodiment, the seat panel 130 may include a pair of hooks 190 attached to a bottom surface thereof to engage the back frame 120 when the folding chair 100 is unfolded. The hooks 190 may be attached on a rear end portion of the bottom surface of the seat panel 130. Particularly, the hooks 190 may be configured to engage the horizontal bar 126 of the back frame 120 to stop the seat panel 130 at a predetermined location when the folding chair 100 is in the unfolded position. This may prevent any excessive pressure applied to the seat panel 130 from damaging the structural integrity of the folding chair 100. The hooks 190 may be configured to ensure firm engagement to and smooth disengagement from the horizontal bar 126. The hooks 190 may also be used to establish the pivotal connection between the seat panel 130 and the seat frame 140. For example, as mentioned above, the hooks 190 may be attached to the rear end portion of the bottom surface of the seat panel 130. The hooks 190 may be then pivotally attached to the seat frame 140 using the rivets 170*b* such that the seat panel 130 may pivotally move about the rivets 170*b*.

Figure 4:
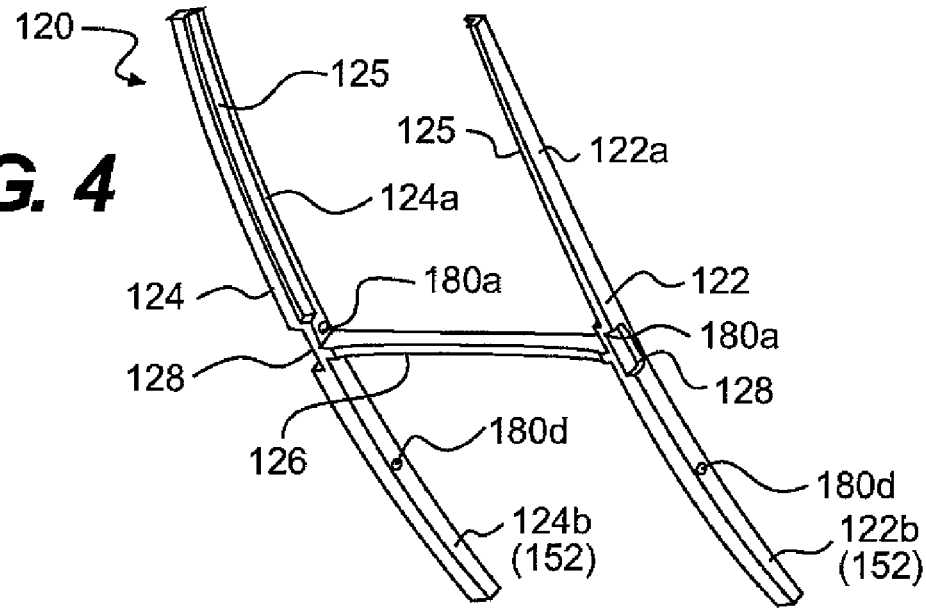
FIG. 4 shows a detailed view of the back frame of the folding chair of FIGS. 2 and 3 constructed according to the principles of the invention.

FIG. 4 shows an exemplary construction of the back frame 120 constructed according to the principles of the invention. As mentioned above, the back frame 120 may be "H" shaped and constructed with the vertical bars 122, 124 interconnected by the horizontal bar 126. The vertical bars 122, 124 may include recesses 128 and holes 180*a* formed within the recesses 128 to engage the seat frame 140. The back frame 120 may further include holes 180*d* arranged at the rear legs 152 to engage the link 160. The upper portions 122*a*, 124*a* may have cutouts 125 formed along an inner front surface thereof to receive the seat panel 100.

Figure 5:
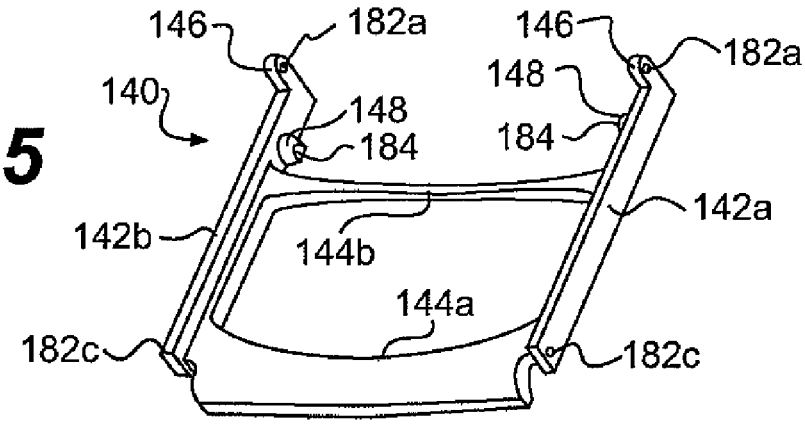
FIG. 5 shows a detailed view of the seat frame of the folding chair of FIGS. 2 and 3 constructed according to the principles of the invention.

FIG. 5 shows an exemplary construction of the seat frame 140 constructed according to the principles of the invention. The seat frame 140 may be constructed with a pair of side frames 142*a*, 142*b* and front and rear bridge frames 144*a*, 144*b* interconnecting the side frames 142*a*, 142*b*. Each of the side frames 142*a*, 142*b* may include a rear end portion 146, a protrusion 148 and holes 182*a*, 182*c*, 184. In an embodiment, the rear end portion 146 may be "L" shaped to engage the recess 128 of the back frame 120. The hole 182*a* may be formed at the upwardly protruded end of the rear end portion 146 so as to align with the hole 180*a* of the back frame 120 when the rear end portion 146 is engaged to the recess 128 of the back frame 120. Rivets 170*a* may be inserted through the holes 182*a*, 180*a* to pivotally connect the seat frame 140 to the back frame 120.

The protrusions 148 may protrude from an inner side surfaces of the side frames 142*a*, 142*b*. Each of the protrusions 148 may include the hole 184 to engage the rivet 170*b*. The protrusions 148 may be configured to engage the hooks 190 with the rivet 170*b* to establish the pivotal movement of the seat panel 130. The holes 182*c* may be arranged in the front side portions of side frames 142*a*, 142*b* to align with the holes 156 of the front legs 150. The front and rear bridge frames 144*a*, 144*b* may be configured to support the seat panel 130 when the folding chair is in the unfold position. The shapes and locations of the front and rear bridge frames 144*a*, 144*b* may varied as long as there is no interference with the pivotal moment of the seat panel 130 when the folding chair 100 is folded.

Figure 6:
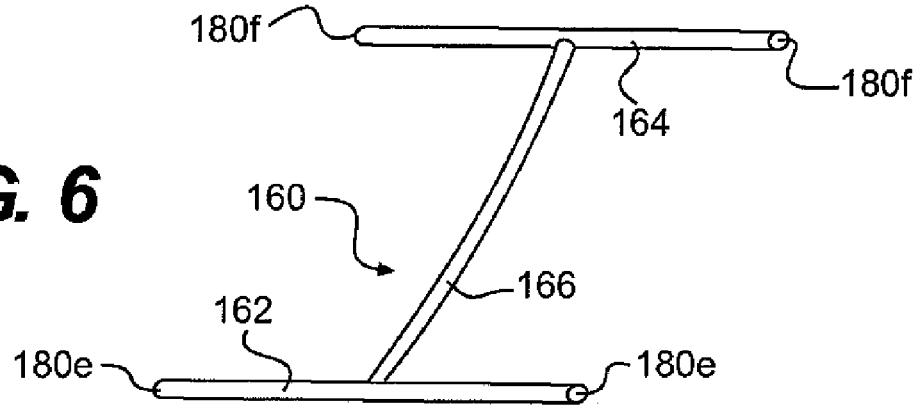
FIG. 6 shows a detailed view of the link of the folding chair of FIGS. 2 and 3 constructed according to the principles of the invention.
Figure 7A:
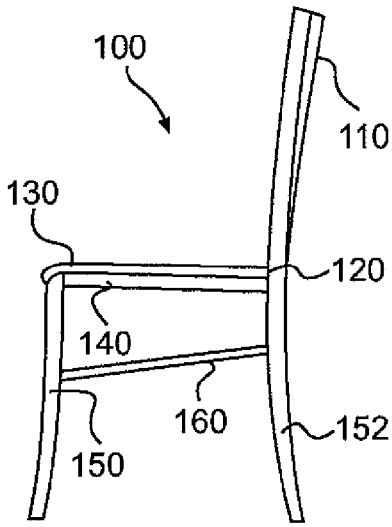
FIGS. 7(*a*), 7(*b*), 7(*c*), 7(*d*) and 7(*e*) sequentially show side views of the folding chair of FIG. 2 in various degrees of folding constructed according to the principles of the invention.
Figure 7B:
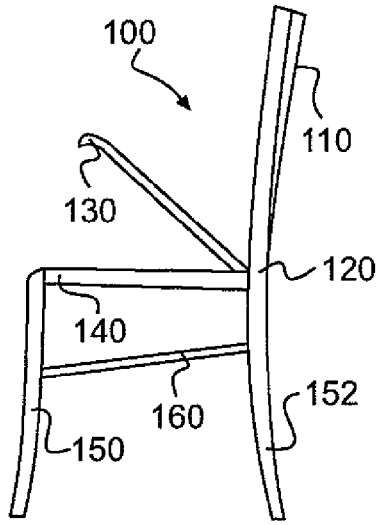
Figure 7C:
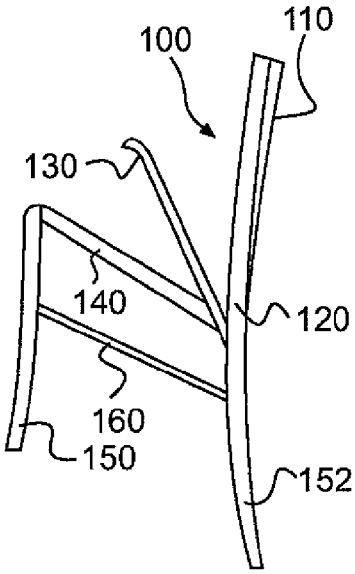
Figure 7D:
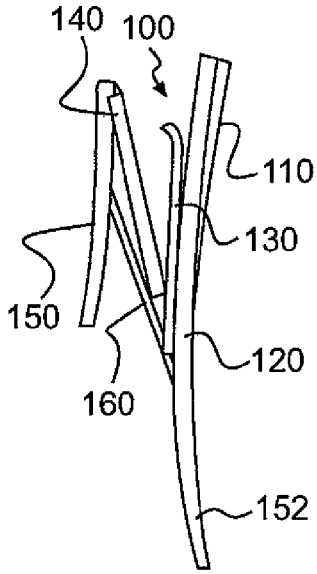
Figure 7E:
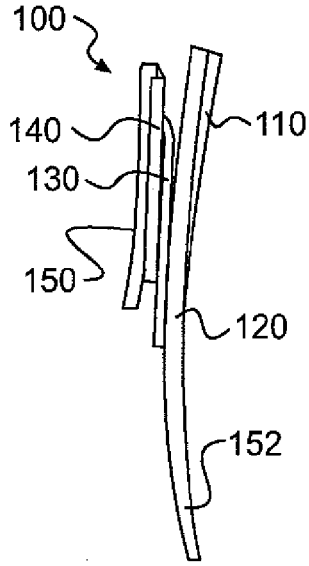
Figure 8A:
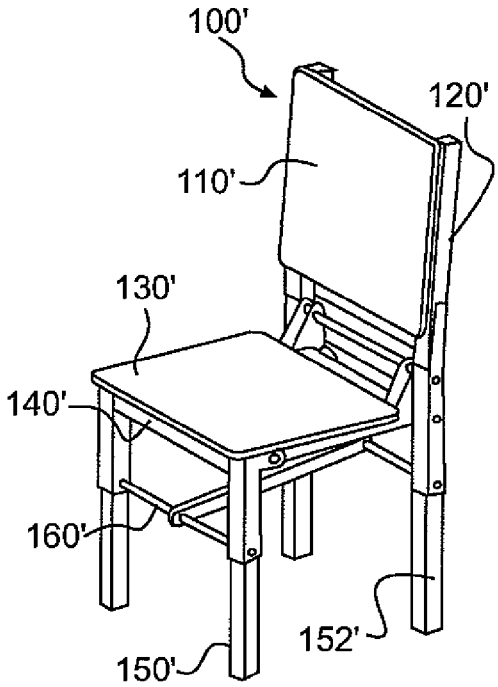
FIGS. 8(*a*), 8(*b*), 8(*c*) and 8(*d*) sequentially show perspective views of another folding chair in various degrees of folding constructed according to the principles of the invention.
Figure 8B:
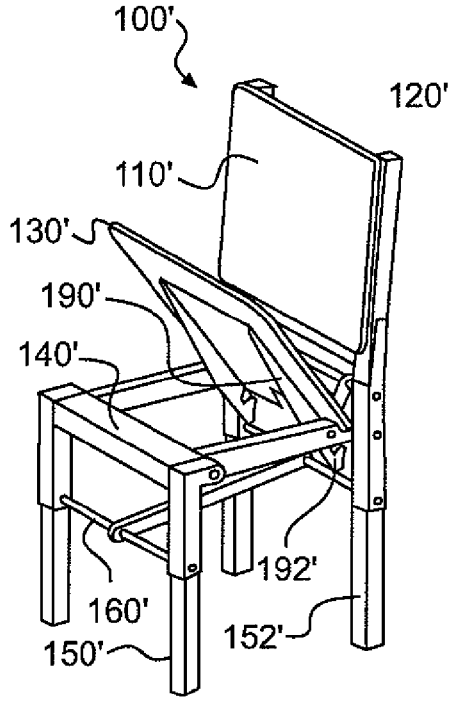
Figure 8C:
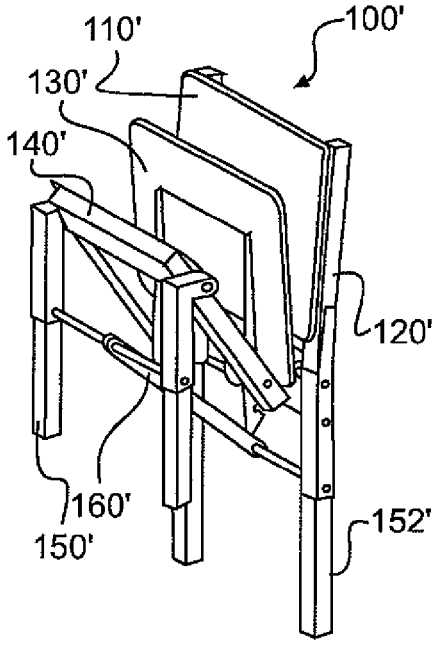
Figure 8D:
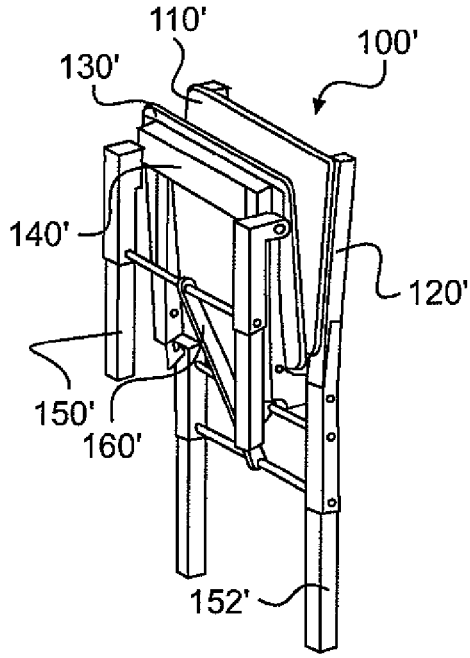

FIG. 6 shows an exemplary configuration of the link 160 constructed according to the principles of the invention. The link 160 may be constructed with a front bar 162, a rear bar 164 and a bridge 166 interconnecting the front and rear bars 162, 164. The front bar 162 may have holes 180*e* at both ends thereof. Similarly, the rear bar 164 may have holes 180*f* at both ends thereof. In assembly, the holes 180*e* of the front bar 162 may be aligned with holes 154 of the front legs 150, and the holes 180*f* of the rear bar 164 may be aligned with the holes 180*d* of the rear legs 152. Then, the rivets 170*d* may be inserted into the holes 154 of the front legs 150 and the holes 180*e* of the front bar 162 to establish the pivotal connection therebetween. Similarly, the rivets 170*d* may be inserted into the holes 180*d* of the rear legs 12 and the holes 180*f* of the rear bar 164 to establish the pivotal connection therebetween.

FIGS. 7(*a*), 7 (*b*), 7 (*c*), 7 (*d*) and 7 (*e*) sequentially show side views of the folding chair 100 prior to and during a folding movement. FIG. 7(*a*) shows the chair 100 being in the unfolded position. The link 160 extended from the rear legs 152 may maintain a predetermined distance between the front legs 150 and the rear legs 152, which may prevent the front legs 150 from being accidentally folded. Thus, the seat frame 140 may be firmly supported by the front legs 150 and the rear legs 152 in the unfolded position. Also, as mentioned above with reference to FIG. 3, the hooks 190 may be engaged to the horizontal bar 126 of the rear frame 120, which may ensure the folding chair 100 stay in the unfolded position. To fold the folding chair 100, as shown in FIG. 7(*b*), the user may lift the seat panel 130 to separate the seat panel 130 from the seat frame 140 and disengage the hooks 190 from the horizontal bar 126 of the back frame 120. Once the hooks 190 are disengaged from the horizontal bar 126, the user may pivotally move the seat frame 140 towards the back panel 110, as shown in FIG. 7(*c*). When the seat frame 140 pivotally moves about the rivets 170*a* (see FIG. 3), the front legs 150 may be folded about the rivets 170*c* because the link 160 may pull the front legs 150 towards the bottom of the seat frame 140 to maintain the predetermined distance between the front legs 150 and the rear legs 152. As shown in FIG. 7(*d*), as the seat frame 140 continues to pivotally move towards the back panel 110, the seat panel 130 may be completely folded and adjoin the back panel 110, and the front legs 150 may be pivotally pulled further towards the bottom of the seat frame 140 by the link 160. FIG. 7(*e*) shows the folding chair 100 in the folded position, in which the seat frame 140 is completely folded to adjoin the seat panel 130 and the front legs 150 are also completely folded to adjoin the seat frame 140. As shown in FIG. 7(*e*), the folding chair 100 in the folded position may be very compact. Also, since the seat panel 130 is separated from the seat frame 140 by the folding movement, the folding chair 100 may be less trouble-prone and more reliable than conventional folding chairs.

FIGS. 8(*a*), 8(*b*), 8(*c*) and 8(*d*) sequentially show perspective views of another folding chair 100' prior to and during a folding movement, constructed according to the principles of the invention. Although the folding chair 100' may not have the identical appearance of the folding chair 100 shown in FIG. 2, the construction, main components and operational principles thereof may be substantially the same as those of the folding chair 100. FIG. 8(*a*) shows the folding chair 100' in the unfolded position. The folding chair 100' may be constructed with a back panel 110', a back frame 120', a seat panel 130', a seat frame 140', front legs 150'. The lower portions of the back frame 120' may constitute rear legs 152' of the folding chair 100'. FIG. 8(*b*) shows the seat panel 130' being lifted towards the back panel 110'. As shown therein, hooks 190' may be attached on the bottom surface of the seat panel 130' to form a pivotal connection between the seat panel 130' and the seat frame 140'. As mentioned above, rear end portions 192 of the hooks 190' may be configured to engage the rear frame 120' when the chair 100' in the unfolded position. FIG. 8(*b*) shows the rear end portions 192 of the hooks 190' being disengaged from the rear frame 120'. FIG. 8(*c*) shows the seat frame 140' being pivotally pulled towards the back panel 110' and the front legs 150' being pulled towards the bottom of the seat frame 140' by the link 160'. FIG. 8(*c*) shows the folding chair 100' in the folded position, in which the seat frame 140' is completely folded and the front legs 150' are pulled to adjoin the bottom of the seat panel 140' by the link 160'. Thus, according to the invention, a folding chair that is less bulky, less trouble-prone, more reliable, and more visually attractive compared to conventional folding chairs.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed is:

1. A folding chair, comprising:

a back frame comprising at least one rear leg;

a seat frame pivotally connected to the back frame;

at least one hook pivotally connected to the seat frame, the at least one hook configured to engage the back frame when the chair is in an unfolded position, thereby preventing folding the chair;

at least one front leg pivotally connected to the seat frame;

a link connected to the at least one front leg and to the at least one rear leg, the link configured to pull the front leg toward the back frame when the folding chair is folded; and a seat panel connected to the at least one hook, the seat panel configured to pivot with the at least one hook relative to the seat frame, the seat panel further configured to disengage the at least one hook from the back frame, thereby permitting folding the chair.

2. The folding chair of claim 1, further comprising a back panel attached to the back frame.

3. The folding chair of claim 2, wherein the back frame comprises:

a pair of vertical bars, each comprising an upper portion and a lower portion; and a horizontal bar interconnecting the pair of vertical bars, wherein the lower portions of the pair of vertical bars comprise two of the at least one rear leg to form a pair of rear legs.

4. The folding chair of claim 3, wherein the back panel is attached to the upper portions of the pair of vertical bars.

5. The folding chair of claim 3, wherein the at least one front legs comprises a pair of front legs.

6. The folding chair of claim 5, wherein the seat frame comprises:

a pair of side frames pivotally connected to the rear frame, the seat panel and the pair of front legs; and a bridge frame connected to the pair of side frames and configured to support the seat panel when the folding chair is unfolded.

7. The folding chair of claim 6, wherein the side frames comprise L-shaped rear end portions pivotally connected to ends of the vertical bars, respectively.

8. The folding chair of claim 7, wherein each vertical bar comprises a cutout portion configured to engage the L-shaped rear end portion of the side frame of the seat frame.

9. The folding chair of claim 6, further comprises a plurality of rivets pivotally connecting the pair of side frames to the rear frame, the seat panel and the pair of front legs.

10. The folding chair of claim 3, wherein the at least one front leg comprises a pair of front legs.

11. The folding chair of claim 10, wherein the link comprises:

a front bar connected to the pair of front legs;

a rear bar connected to the pair of rear legs; and a bridge coupled between the front bar and the rear bar.

12. The folding chair of claim 11, further comprises a plurality of rivets pivotally connecting the front and rear bars of the link to the front and rear legs.

13. The folding chair of claim 1, wherein the at least one hook comprises a pair of hooks attached on a bottom surface of the seat frame and pivotally connected to inner side surfaces of the side frames of the seat frame.

14. A folding chair comprising:

a rear frame comprising a pair of rear legs;

a rear panel attached to the rear frame;

a seat frame pivotally attached to the rear frame and configured to move towards the rear panel when the folding chair is folded;

at least one hook pivotally connected to the seat frame, the at least one hook configured to engage the rear frame when the chair is in an unfolded position, thereby preventing folding the chair;

a seat panel connected to the at least one hook, the seat panel configured to pivot with the at least one hook relative to the seat frame, the seat panel further configured to disengage the at least one hook from the rear frame, thereby permitting folding the chair;

a pair of front legs pivotally attached to the seat frame; and a link pivotally connected to the pair of front legs and to the pair of rear legs and configured to pull the pair of front legs towards to rear frame when the folding chair is folded.

15. The folding chair of claim 14, further comprises a plurality of rivets pivotally connecting the seat frame to the rear frame, the seat panel and the pair of front legs, and pivotally connecting the link to the pair of front legs and the pair of rear legs.

16. The folding chair of claim 14, wherein the rear frame comprises:

a pair of vertical bars, each divided into an upper portion and a lower portion, wherein the lower portions of the pair of vertical bars constitute the pair of rear legs;

a horizontal bar extending between the pair of vertical bars, wherein the at least one hook engages the horizontal bar when the folding chair is unfolded.

17. The folding chair of claim 14, wherein the at least one hook comprises a pair of hooks attached at a bottom surface of the seat panel and configured to pivotally connect the seat panel to the seat frame.

18. The folding chair of claim 17, wherein the link comprises:

a front bar pivotally connected to the pair of front legs;

a rear bar pivotally connected to the pair of rear legs; and a bridge extending between the front bar and the rear bar.

* * * * *